US006997689B2

(12) United States Patent
Lafferty et al.

(10) Patent No.: US 6,997,689 B2
(45) Date of Patent: Feb. 14, 2006

(54) OFFSET BEARING FOR EXTENDED FUEL PUMP LIFE

(75) Inventors: Gregory A. Lafferty, Plymouth, IN (US); David J. Lawrence, South Bend, IN (US)

(73) Assignee: Honeywell International Inc., Morris Township, NJ (US)

( * ) Notice: Subject to any disclaimer, the term of this patent is extended or adjusted under 35 U.S.C. 154(b) by 82 days.

(21) Appl. No.: 10/369,848

(22) Filed: Feb. 20, 2003

(65) Prior Publication Data

US 2004/0166010 A1 Aug. 26, 2004

(51) Int. Cl.
*F03C 2/00* (2006.01)

(52) U.S. Cl. ..... 418/206.7; 418/39; 418/132; 29/888.021

(58) Field of Classification Search ..... 29/888.021, 29/888.023; 418/39, 131, 132, 206.7
See application file for complete search history.

(56) References Cited

U.S. PATENT DOCUMENTS

| | | | | |
|---|---|---|---|---|
| 1,486,835 A | | 3/1924 | Hill | |
| 1,486,836 A | | 3/1924 | Hill | |
| 1,516,591 A | | 11/1924 | Edwards | |
| 1,648,730 A | | 11/1927 | Hill | |
| 2,076,664 A | | 4/1937 | Nichols | |
| 2,091,317 A | | 8/1937 | Hill | |
| 2,445,967 A | | 7/1948 | Pigott et al. | |
| 2,745,355 A | | 5/1956 | Mosbacher | |
| 2,792,788 A | | 5/1957 | Eames, Jr. | |
| 2,822,124 A | | 2/1958 | Klessig et al. | |
| 3,034,448 A | | 5/1962 | Brundage | |
| 3,198,127 A | | 8/1965 | Brundage | |
| 3,427,983 A | | 2/1969 | Brundage | |
| 3,574,489 A | | 4/1971 | Pierrat | 418/210 |
| RE27,228 E | | 11/1971 | Brundage | |
| 3,680,989 A | | 8/1972 | Brundage | 418/171 |
| 4,922,781 A | | 5/1990 | Peiji | 418/171 |
| 4,969,806 A | | 11/1990 | Nusser | 418/171 |
| 5,090,883 A | | 2/1992 | Krauter et al. | |
| 5,252,047 A | * | 10/1993 | Joy | 418/132 |
| 5,628,626 A | | 5/1997 | Hansen | 418/171 |
| 6,053,718 A | | 4/2000 | Schmidt et al. | 418/171 |
| 6,077,059 A | | 6/2000 | Hosono | 418/171 |
| 6,152,717 A | | 11/2000 | Morita et al. | 418/171 |
| 6,280,167 B1 | | 8/2001 | Pahl et al. | 418/171 |

FOREIGN PATENT DOCUMENTS

| | | | | |
|---|---|---|---|---|
| GB | 1055517 | | 1/1967 | |
| JP | 60-19977 | * | 2/1985 | 418/131 |
| JP | 9-256967 A | | 9/1997 | |
| JP | 11-236883 | * | 8/1999 | 418/132 |
| RU | 1335729 | * | 9/1987 | 418/132 |

* cited by examiner

*Primary Examiner*—Theresa Trieu
(74) *Attorney, Agent, or Firm*—Birch, Stewart, Kolasch, & Birch, LLP.

(57) ABSTRACT

A bearing assembly (20) for a pump (12), e.g., an internal or external gear pump includes a journal bearing block (20) having a length, a width, and an axial centerline (CL') passing through a center of the journal bearing block (20) with respect to the length. The journal bearing block (20) includes at least two journal bearing bores (21), the journal bearing bores (21) each having a center (C), wherein a bearing bore centerline (CL) extends between the centers (C) of the journal bearing bores (21) and in parallel with the bearing bore centerline (CL). The bearing bore centerline (CL) is offset with respect to the width of the journal bearing block (20) and the axial centerline (CL'). The bearing assembly (20) is particularly applicable to gear pumps, such as external gear pumps for fuel applications.

12 Claims, 7 Drawing Sheets

OFFSET BEARING FOR EXTENDED FUEL PUMP LIFE

TECHNICAL FIELD AND INDUSTRIAL APPLICABILITY OF THE INVENTION

The present invention is generally directed to the field of gear pumps, and more particularly to gear pumps having offset bearings that effectively counteract and/or reduce wear in gear pump housings, gears and related components.

BACKGROUND OF THE INVENTION

The inventors of the present invention have determined that there are numerous shortcomings with the methods and apparatus of the background art relating to gear pumps, specifically external gear pumps.

FIGS. 1(*a*)–(*c*) are partial sectional views showing the operation of an external gear pump of the background art. FIGS. 2(*a*)–(*d*) are partial sectional views showing the operation of an internal gear pump of the background art. FIG. 3 is an isometric view of an internal gear shaft of an internal gear pump of the background art having an internal and an external gear component. FIG. 4 is a perspective view of an external gear pump according to the background art. As seen in FIGS. 2(*a*)–(*d*) and FIG. 3, internal gear pumps generally include a rotating shaft 1 providing a rotational force to a rotor 2, e.g., a larger external gear assembly. A smaller, idler gear 3 is positioned within the external gear assembly, e.g., internal to the rotor 2. Internal gear pumps are generally well-suited for high-viscosity fluids that require medium to low pressure applications. Internal gear pumps are self-priming, relatively simple in design, e.g., only two moving parts and are relatively easy to maintain.

External gear pumps also rely upon the intermeshing of two gears to pump a fluid. However, as seen in FIGS. 1(*a*)–(*c*), two identical gears 5, 6 are positioned in a side-by-side arrangement within a generally oval-shaped housing 7 of an external gear pump 12. Typically, only one of the shafts 8, 9 are powered by a motor or other motive force, thereby operating both gears 5,6, as the drive gear 5 in turn drives the driven gear 6 through the meshing arrangement of the two gears 5,6. One of skill in the art will appreciate that only two gears 5,6 are shown in the accompanying figures to simplify the following discussion. However, the present inventors submit that it is common to add additional gears onto a pump shaft, e.g. in a double geared design where each shaft includes concentric gears and adjacent pumping chambers.

As seen in FIG. 1(*a*), a fluid such as fuel oil is supplied at a pump inlet 10 side of the pump 12. As the gears 5,6 rotate, the fluid is drawn into the teeth 11 of the gears 5,6. As seen in FIG. 1(*b*), the fluid travels around the circumference of the gears 5,6, e.g., between the sides of the housing 7 and gears 5,6, with relatively little or no fluid passing between the gears themselves. As seen in FIG. 1(*c*), the pressurized fluid is forced through a pump outlet side 13 of the pump 12. As the individual teeth 11 of the gears release from their meshing arrangement on the inlet side of the pump 12, a low-pressure region is formed that draws additional fuel into the pump inlet 10 to continue the pumping process.

External gear pumps are particularly advantageous for medium to high-pressure applications involving a wide range of fluids and materials, e.g., external gear pumps may be utilized for corrosive and non-corrosive fluids with optimization of construction materials depending on the application. Further, external gear pumps are typically favored in the background art due to the fact that the gears 5,6 and shafts 8,9 of the pump 12 are supported on both sides by bearings, e.g., in contrast to the overhanging design of the internal gear shaft 1 shown in FIG. 3, thus providing relatively "quiet" pump operation in wide ranges of applications, including high pressure hydraulic applications.

Since external gear pumps are supported on both sides of the gears 5,6 of the pump 12 by bearings, it is generally thought by those skilled in the art that premature wear of the gears 5,6, shafts 8,9 and housing 7 is mitigated by the balancing of loads and prevention of deflection of the shaft(s). FIGS. 5 and 6 of the present application show a common external gear pump assembly of the background art. FIG. 5 is a cross-sectional view of an external gear pump having a pair of shafts and a pair of bearing supports according to the background art. FIG. 6 is a cross-sectional view of an external gear pump according to the background art taken along a line extending through the pumping chamber.

A more detailed description of the operation and construction of the external gear pump shown in FIGS. 5 and 6 is provided in U.S. Pat. No. 6,035,718 to Schmidt et al., the entirety of which is hereby incorporated by reference. The external gear pump 12 includes shafts 8, 9 (drive shaft 8), gears 5, 6, (drive gear 5) a pump inlet 10, a pump outlet 13, and gear teeth 11 contacting a wear layer 16 of an interior 15 of the pump chamber at contact points 11'. Spaces 14 between the gear teeth 11 and the interior 15 of the pump chamber allow entrapped fluid to be pumped by the pump 12 during operation. The housing 7 includes journal bearing blocks 20, 20 on either side of, e.g., along lateral surfaces 17, 17, the gears 5,6. The journal bearing blocks 20,20 include journal bearing bores 21, 21 for accommodating and supporting the shafts 8,9 of the gear pump 12.

The present inventors have determined that gear pumps of the background art suffer from the following disadvantages. Forces acting on the gear area of a gear pump are a result of the pressure differential from pump inlet to pump outlet and the pump torque. As described hereinabove, a high pressure region is created at the outlet 13 side of the pump 12 and a relatively low pressure region is created at the inlet 10 side of the pump 12 during any pumping operation. Accordingly, the shafts 8, 9, gears 5,6 and teeth 11 experience a reactive force F that will act toward the pump inlet's 10 low pressure region during operation. The present inventors have determined that this reactive force F ultimately results in premature wearing of the housing, gears, teeth and shafts as tooth contact 11' and wear.

Further, as bearings and related equipment wear, the shafts 8,9 are more likely to experience deflection that will contribute to additional wear and acceleration of the degradation of pump components. As seen in FIG. 6, the reaction force F is generally opposite to the direction of fluid flow shown leaving the pump outlet 13 and is concentrated along the inlet 10 side of the external gear pump 12 where the gear teeth 11 contact the inlet side of the interior 15,16 of the pump housing 7.

With respect to pump torque, the pump torque acts along a line action in a direction equal to the tooth pressure angle, e.g., typically 25 degrees, through the pitch circle at the point of tooth contact. The forces on the drive and driven gear teeth are equal and opposite. The reaction force for the drive gear is 25 degrees from normal at a direction toward the high-pressure side, e.g., opposite the differential pressure force. The reaction force of the driven gear is 25 degrees from normal toward the low-pressure side, e.g., acting in the same direction as the differential pressure force. However, both of these forces are considerably less than the differential pressure force described hereinabove. The net result is a force on each gear toward the low-pressure side with the drive gear net force being somewhat less than the driven gear net force.

SUMMARY OF THE PRESENT INVENTION

The present invention overcomes the shortcomings associated with the background art and achieves other advantages not realized by the background art. The present invention is intended to alleviate one or more of the following problems and shortcomings of the background art specifically identified hereinabove by the inventors with respect to the background art.

The present invention, in part, is a recognition that it will be advantageous to achieve reduced wear in gear pumps, particularly wear caused by reactive forces contributing to premature wear along a gear-housing interface on an inlet side of a pump.

The present invention, in part, is a recognition that wear of pump components significantly contributes to operating and repair costs of pump assemblies.

The present invention, in part, is a recognition that replacement of a minimal number of components during pump maintenance procedures will significantly reduce operating costs.

The present invention, in part, is a recognition that it will be advantageous to reduce the frequency of repair of the more expensive components of gear pumps, for example avoiding the maintenance and replacement of expensive parts such as pump housings.

The present invention, in part, provides a bearing for a pump comprising a journal bearing block, the journal bearing block having a length, a width, and an axial centerline passing through a center of the journal bearing block with respect to the length; at least two journal bearing bores, the journal bearing bores each having a center, wherein a bearing bore centerline extends between the centers of the journal bearing bores; wherein the bearing bore centerline is offset with respect to the width of the journal bearing block and in parallel with the axial centerline.

The present invention, in part, provides a bearing for a gear pump comprising an oval-shaped journal bearing block, the journal bearing block having a length, a width, and an axial centerline passing through a center of the journal bearing block with respect to the length; at least two journal bearing bores, the journal bearing bores each having a center, wherein a bearing bore centerline extends between the centers of the journal bearing bores; wherein the bearing bore centerline is offset with respect to the width of the journal bearing block and in parallel with the axial centerline.

The present invention, in part, provides a gear pump comprising a pump housing; a pump inlet and a pump outlet; at least two gears, each of the gears having a plurality of intermeshing gear teeth; at least two rotor shafts being operatively connected to the at least two gears; a journal bearing block within the pump housing, the journal bearing block having a length, a width, and an axial centerline passing through a center of the journal bearing block with respect to the length; at least two journal bearing bores within the journal bearing block, the journal bearing bores each having a center, wherein a bearing bore centerline extends between the centers of the journal bearing bores; wherein the bearing bore centerline is offset with respect to the width of the journal bearing block and in parallel with the axial centerline.

The present invention, also in part, provides methods of repairing or reducing wear in a worn gear pump comprising a pump housing, at least two intermeshing gears, at least two rotating shafts supported within at least one journal bearing block having at least two journal bearing bores, wherein the at least one journal bearing block has a length, a width, and an axial centerline passing through a center of the at least one journal bearing block with respect to the length, the method comprising offsetting the at least two journal bearing bores with respect to either an inlet side or an outlet side of the pump, wherein the journal bearing bores each have a geometric center and a bearing bore centerline extending between the centers of the journal bearing bores; wherein the bearing bore centerline is offset with respect to the width of the journal bearing block and in parallel with the axial centerline.

BRIEF DESCRIPTION OF THE DRAWINGS

The present invention will become more fully understood from the detailed description given hereinafter and the accompanying drawings that are given by way of illustration only, and thus do not limit the present invention.

DETAILED DESCRIPTION OF THE PREFERRED EMBODIMENTS

Figure 1A:
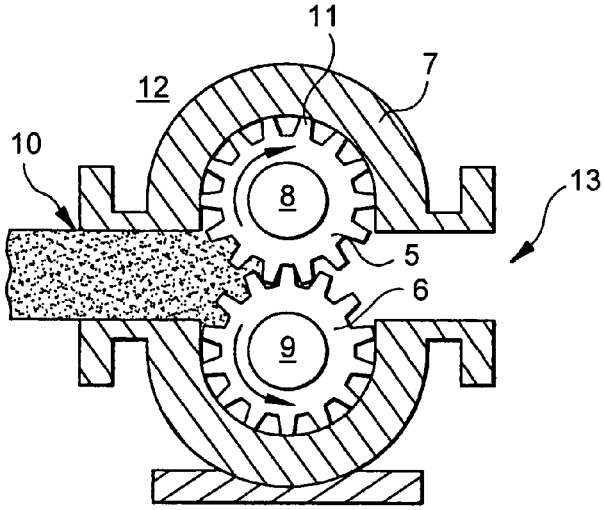
FIG. 1a (BACKGROUND ART)
FIGS. 1(*a*)–(*c*) are partial sectional views showing the operation of an external gear pump of the background art.
Figure 1B:
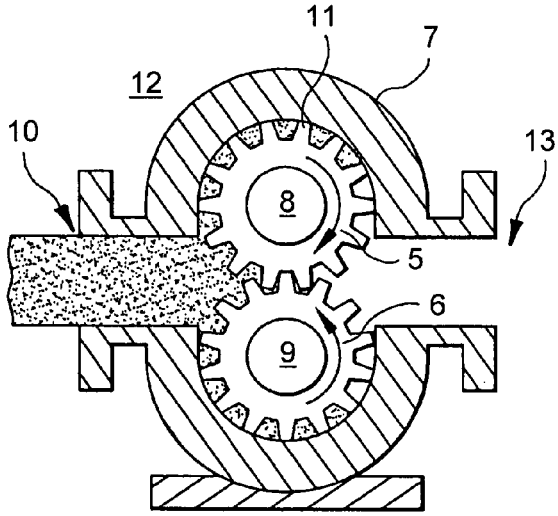
FIG. 1b (BACKGROUND ART)
Figure 1C:
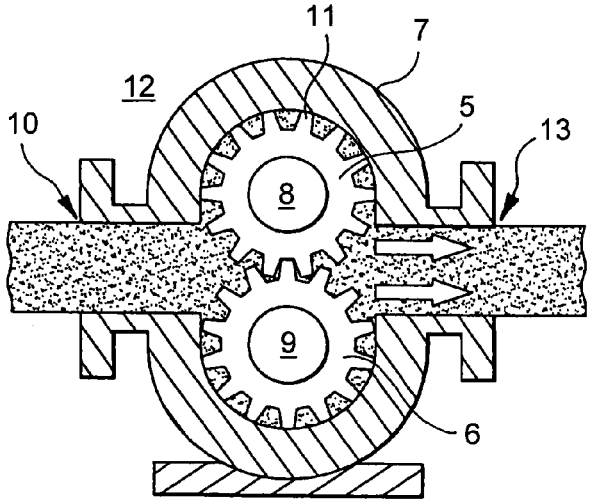
FIG. 1c (BACKGROUND ART)
Figure 2A:
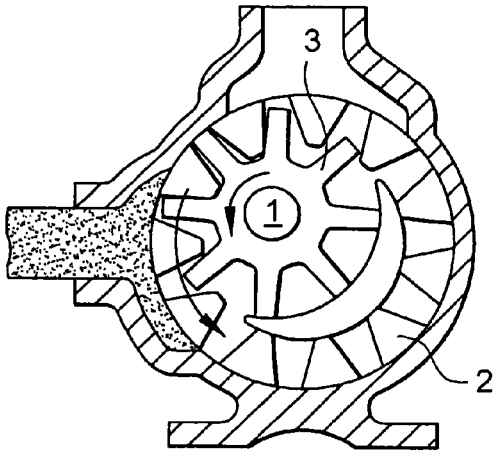
FIG. 2a (BACKGROUND ART)
FIGS. 2(*a*)–(*d*) are partial sectional views showing the operation of an internal gear pump of the background art.
Figure 2B:
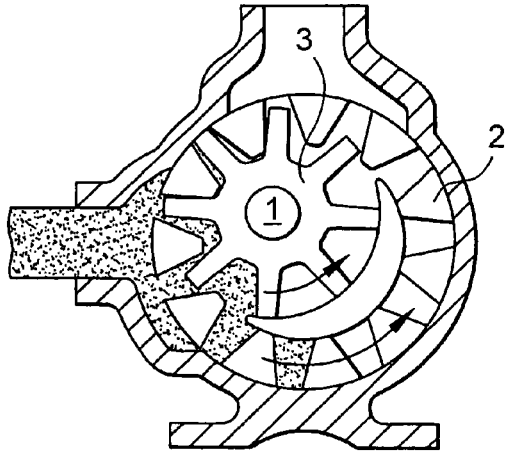
FIG. 2b (BACKGROUND ART)
Figure 2C:
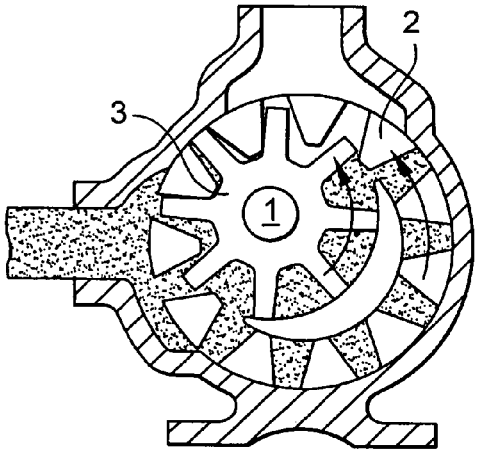
FIG. 2c (BACKGROUND ART)
Figure 2D:
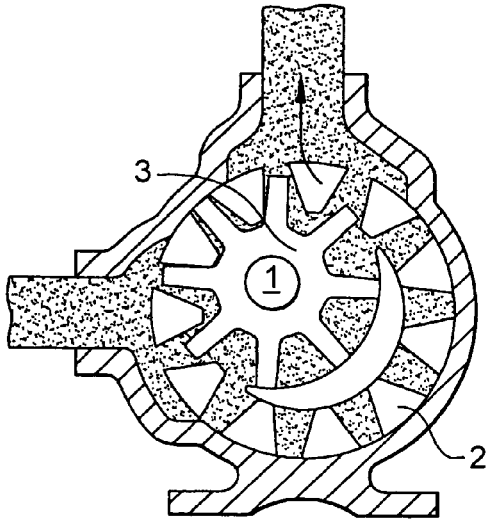
FIG. 2d (BACKGROUND ART)
Figure 3:
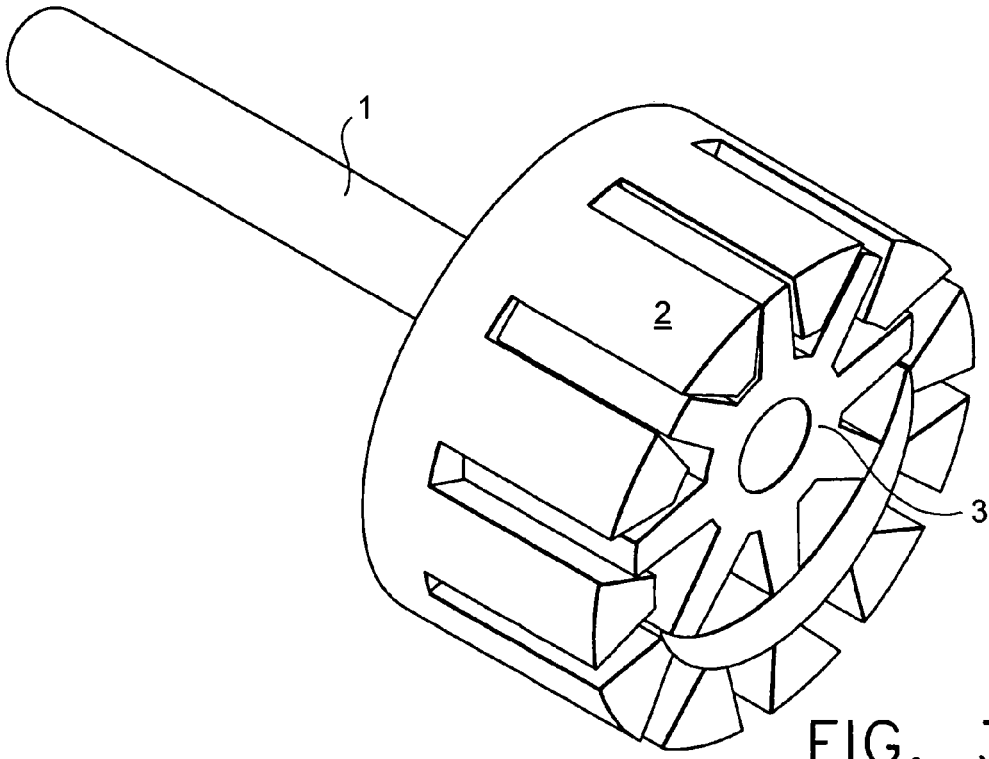
FIG. 3 (BACKGROUND ART)
FIG. 3 is an isometric view of an internal gear shaft of an internal gear pump of the background art having an internal and an external gear component.
Figure 4:
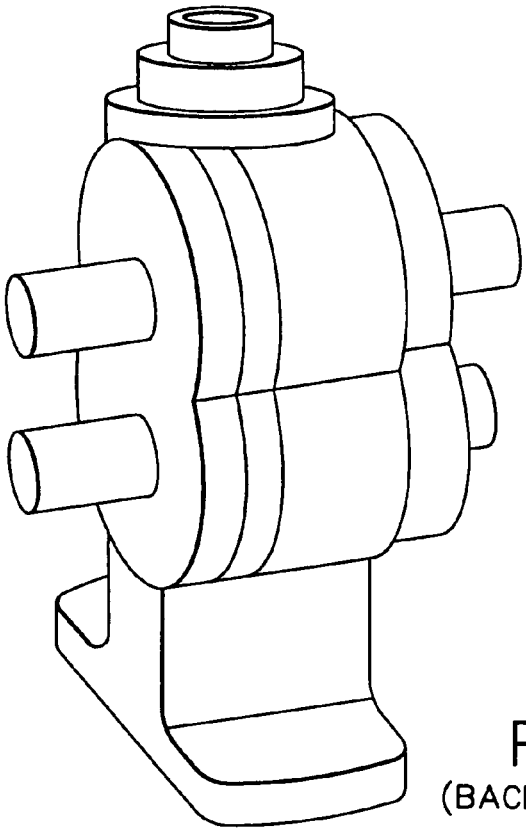
FIG. 4 (BACKGROUND ART)
FIG. 4 is a perspective view of an external gear pump according to the background art.
Figure 5:
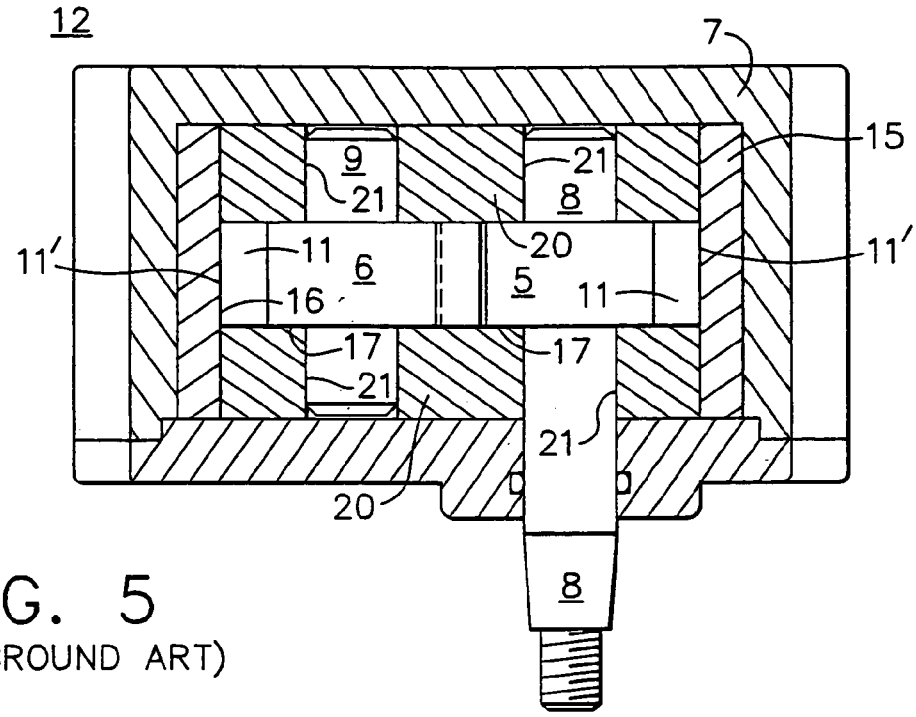
FIG. 5 (BACKGROUND ART)
FIG. 5 is a cross-sectional view of an external gear pump having a pair of shafts and a pair of bearing supports according to the background art.
Figure 6:
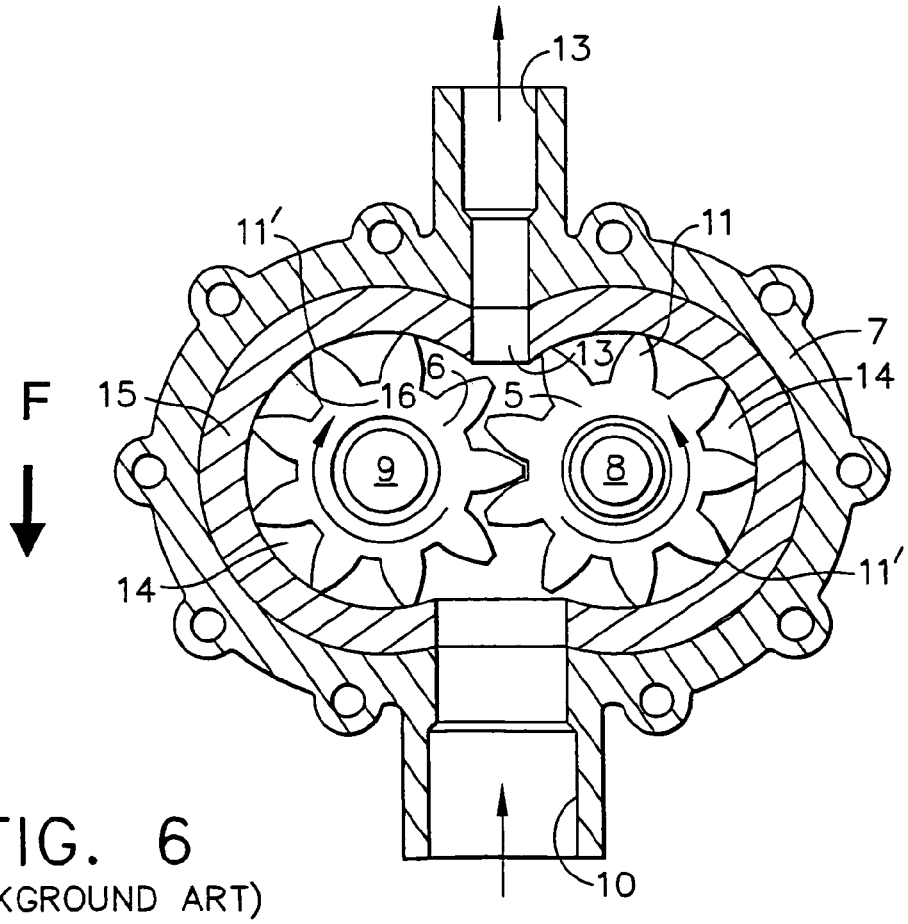
FIG. 6 (BACKGROUND ART)
FIG. 6 is a cross-sectional view of an external gear pump according to the background art taken along a line extending through the pumping chamber.
Figure 7:
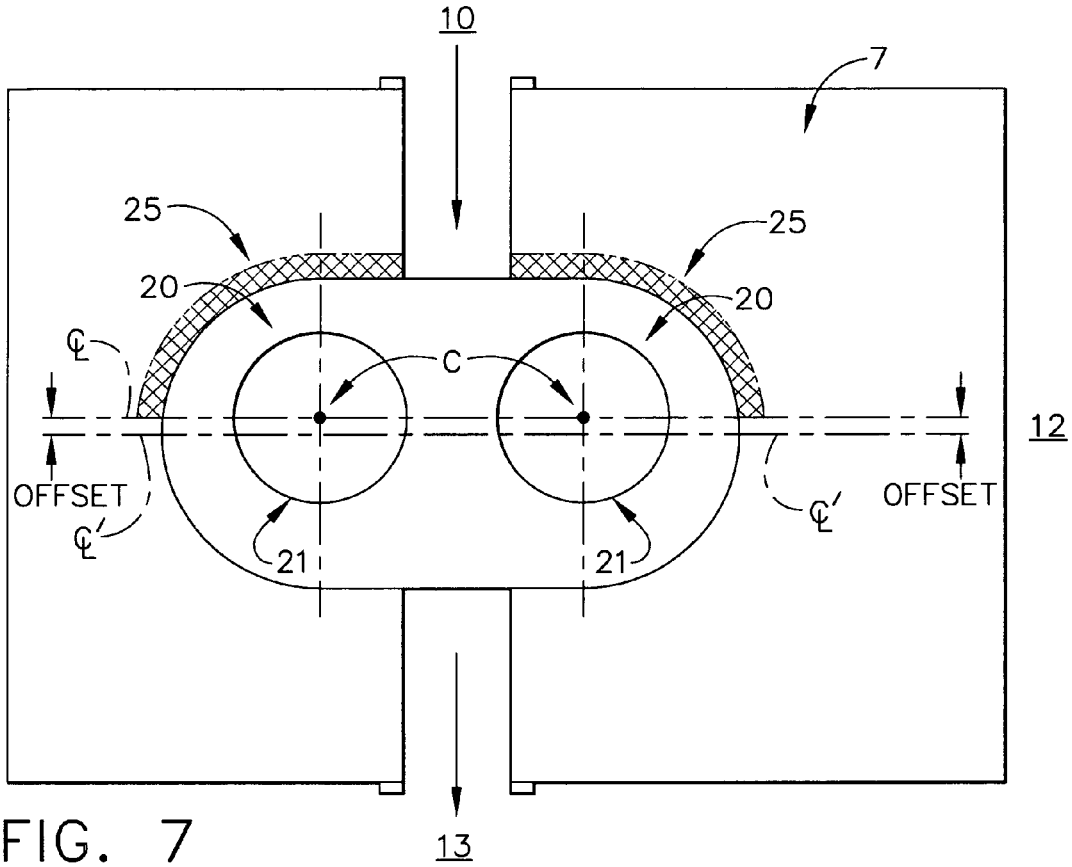
FIG. 7 is a partial, sectional view of an external gear pump bearing assembly according to an embodiment of the present invention.
Figure 8:
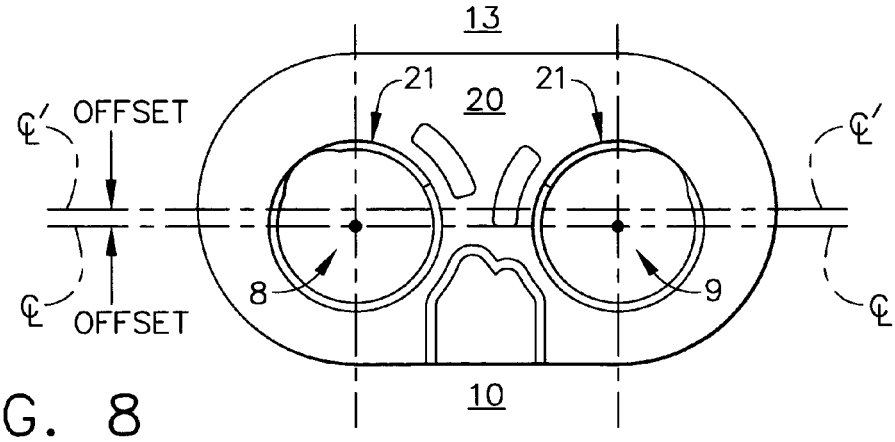
FIG. 8 is a side view of a bearing assembly according to an embodiment of the present invention.
Figure 9:
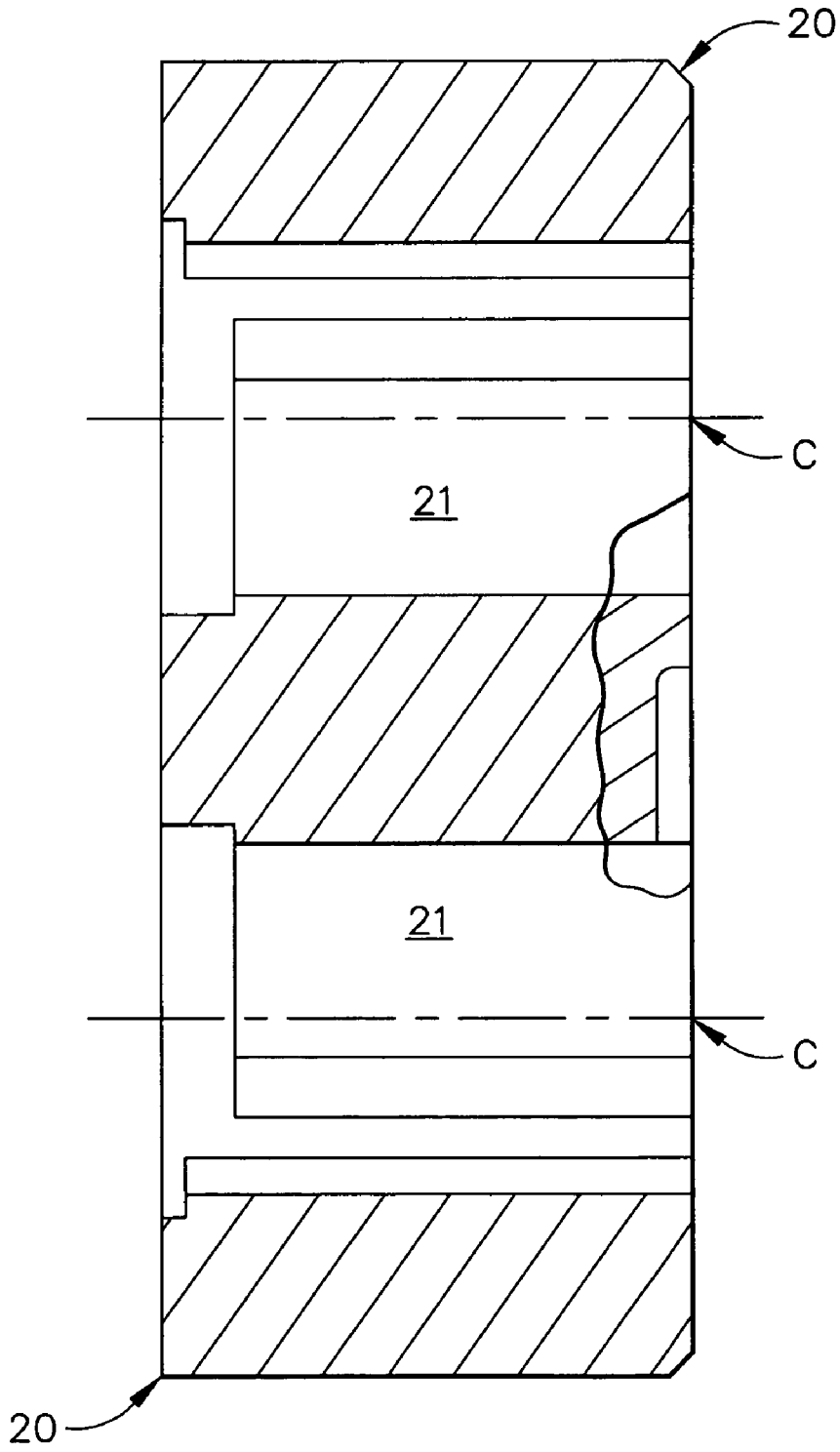
FIG. 9 is a sectional view of the bearing assembly of FIG. 8 taken through the centerline shown in FIG. 8.
Figure 10:
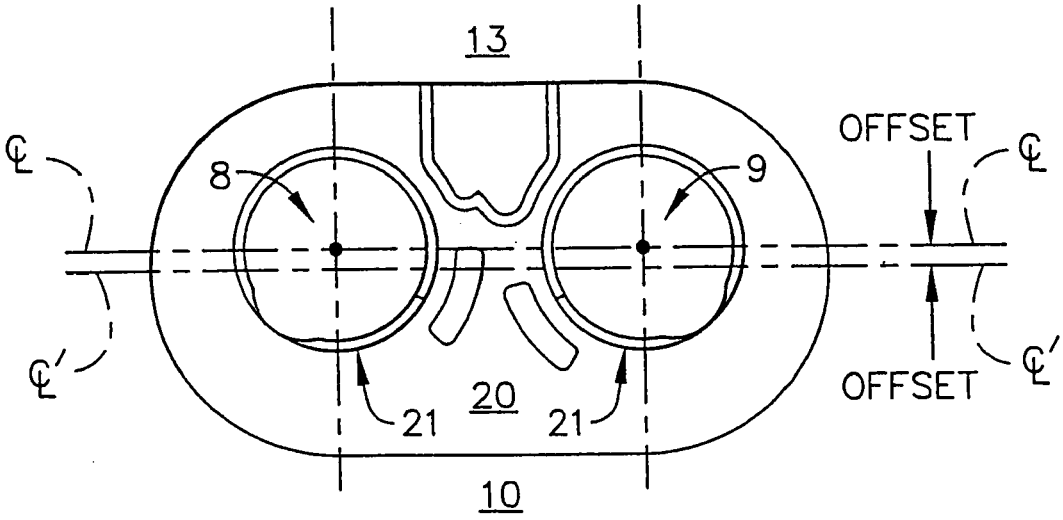
FIG. 10 is a side view of a bearing assembly according to an embodiment of the present invention.

The present invention will now be described in detail with reference to the accompanying drawings. FIG. 7 is a partial, sectional view of an external gear pump bearing assembly according to an embodiment of the present invention. FIG. 8 is a side view of a bearing assembly according to an embodiment of the present invention. FIG. 9 is a sectional view of the bearing assembly of FIG. 8 taken through the centerline shown in FIG. 8.

As described hereinabove, external and internal gear pumps are well known in the background art. For example, the operation, construction and applicable materials of components for gear pumps are described in greater detail in U.S. Pat. No. 6,053,718, the entirety of which has been incorporated by reference to the present application. However, as seen in FIG. 7 of the present application, the present invention provides a journal bearing block assembly 20 (referred to hereinafter as journal bearing assembly or block) having journal bores 21, 21 that have been specifically designed to recover from wear in a gear pump 12 resulting from reactive forces caused by the differential pressure across the pump inlet and pump outlet and/or pump torque, e.g., such as with an external gear pump.

Although an external gear pump is described in the following exemplary embodiment, one of skill in the art will appreciate that the bearing assembly 20 of the present invention may be applied to alternative types and arrangements of gear pumps, e.g., such as single and double geared shafts and/or internal or external gear pumps. In the present embodiment, the journal bearing block 20 is generally oval-shaped. However, one of skill in the art will appreciate that the bearing block 20 may be varied in shaped depending upon the intended pump application.

In the present embodiment, geometric centers C of a pair of journal bearing bores 21, 21 have been offset with respect to a typical axial centerline (CL') commonly utilized in the background art. Accordingly, the actual centerline (CL) of the journal bearing bores 21 of the present invention is purposefully offset toward an inlet side 10 of the pump 12, e.g., the imaginary line extending between the centers C of the journal bearing bores 21, 21. By offsetting the journal bearing bores 21 toward the inlet 10 side of the pump, the present inventors have determined that it is possible to manipulate the positioning of the shafts 8,9 that would fit within the journal bearing bores 21 toward the inlet 10 side of the pump.

The present inventors have determined that these offset journal bearing bores 21, 21 will provide a way of recovering from or repairing a worn gear pump. For example, in contrast to the bearing(s) of gear pump(s) of the background art having zero offset, the offset bearing assembly 20 of the present invention provides several advantages. In the bearings of the gear pump of the background art, the bearings and gear pump will eventually exhibit wear. Due to the reactive forces described hereinabove, personnel are often forced to replace the bearings, gears and eventually the surrounding housing. However, overhauling a gear pump with an offset bearing assembly 20 of the present invention, e.g., toward the low pressure side of the pump, eliminates the gear to housing clearance that resulted from wear. Accordingly, pump performance and costly repairs to additional components, such as the pump housing, are avoided.

The offset journal bearing bores 21 provide an economical way of re-establishing the "as new" gear to housing clearance, e.g., as opposed to scrapping expensive components such as the housing. Accordingly, an area of increased gear tooth protrusion 25 is created with the present invention. Since the journal bearing bores 21 are offset, the respective shafts 8,9 and the teeth 11 of the corresponding gears 5, 6 will protrude more toward an inlet side of the pump than an outlet 13 side of the pump 12. In contrast, the journal bearing bores 21 may also be purposefully offset to the outlet 13 side of the pump if so desired. However, the present inventors have determined that offsetting the journal bearing bores 21 toward the inlet 10 side of the pump significantly counters the likely wear forces encountered by the moving parts of the traditional gear pump 12, and consequently reduces required maintenance efforts.

One of skill in the art will appreciate that the present invention results in a beneficial bearing assembly that can be manufactured and used alone as a single repair piece, and/or or may be employed in various combinations along with a pump housing and/or types of gear pumps, e.g. both internal and external. The present inventors have determined that carbon or carbon composite is a preferred material for a journal bearing assembly 20 installed in an external gear, fuel pump. However, one of skill in the art will appreciate that various materials and combinations of materials may be utilized to meet the requirements of a respective pump application.

During typical pump maintenance and overhaul, several components or even entire pumps may require replacement. Since the present bearing assembly provides a relatively inexpensive repair option, wear of surrounding components, including but not limited to the pump housing 7 and interior surfaces 15, 16 of a pump, is reduced and/or repaired. The present inventors have determined that a repair technician is often able to reuse expensive components such as pump housings and conduct relatively inexpensive replacement of the relatively inexpensive bearing assemblies. In addition, fuel pump performance is reduced or even lost due to the wear of components in pumping systems of the background art that ultimately leads to increased internal fuel leakage. The present inventors have determined that the bearing assembly 20 of the present invention reduces fuel leakage and improves or maintains pump performance.

In addition, external gears pumps are typically subjected to a break-in period in which the pump speed and pressure are sequentially increased to the maximum rated levels. The gear outside diameter slightly overhangs the bearing on the low-pressure side. Thus the break-in is a controlled final machining of the housing using the actual pump gears to create in essence a zero clearance fit between the gears and housing in an arc on each gear of at least two teeth. This creates a separation from low to high-pressure regions, minimizing leakage and maximizing pump performance. As a gear pump is used in the field, the parts wear as a result of dynamic forces and temperature differentials, e.g., is discussed in greater detail hereinabove.

The offset bearing(s) of the present invention allows the gear pump at overhaul to basically "start over" the wear cycle by increasing the overhang with the bearing. Testing by the present inventors has shown that the offset in the range of 0.0015–0.0025 is adequate to enable sufficient re-machining of the housing at break-in The overhauled pump, e.g., with the offset bearing assembly 20 of the present invention, is then run through a break-in period, thereby re-establishing the "zero clearance."

One of skill in the art will appreciate that the degree of offset may be varied depending upon the pump application, e.g., such as the fluids being pumped, the size and capacity of the pump and pressures being generated. However, the present inventors have determined that an offset of approximately 0.001 to 0.0025 is preferred in an exemplary gear pump arrangement, and more preferably between 0.0015–0.0025 inches of offset from the axial centerline (CL') of the bearing assembly 20. The new axial centerline (CL), e.g., the line connecting the centers of the journal bearing bores 21, is offset by the degree of offset defined hereinabove.

What is claimed is:

1. A gear pump comprising:

a pump housing;

a pump inlet and a pump outlet;

at least two gears, each of said gears having a plurality of intermeshing gear teeth;

at least two rotor shafts being operatively connected to said at least two gears;

a journal bearing block within said pump housing, said journal bearing block having a length, a width, and an axial centerline passing through a center of said journal bearing block with respect to said length;

at least two journal bearing bores within said journal bearing block, said journal bearing bores each having a center, wherein a bearing bore centerline extends between said centers of said journal bearing bores; wherein said bearing bore centerline is offset with respect to said width of said journal bearing block and in parallel with said axial centerline and said rotor shafts are rotatably and directly supported by said journal bearing bores within said journal bearing block.

2. The gear pump according to claim 1, wherein said bearing bore centerline has an offset with respect to said journal bearing block and said offset is 0.0015 to 0.0025 inches with respect to said axial centerline.

3. The gear pump according to claim 2, wherein said journal bearing block is made of carbon composite.

4. The gear pump according to claim 2, wherein said journal bearing block is an external gear pump journal bearing, said offset of said bearing bore centerline being offset toward the pump inlet.

5. The gear pump according to claim 2, wherein said journal bearing block is an external gear pump journal bearing, said offset of said bearing bore centerline being offset toward the pump outlet.

6. The gear pump according to claim 1, wherein said journal bearing block is made of carbon composite.

7. The gear pump according to claim 1, wherein said journal bearing block is an external gear pump journal bearing, said offset of said bearing bore centerline being offset toward the pump inlet.

8. A repair method for a worn gear pump comprising a pump housing, at least two intermeshing gears, at least two rotating shafts supported within at least one original journal bearing block having at least two journal bearing bores, wherein said at least one journal bearing block has a length, a width, and an axial centerline passing through a center of said at least one journal bearing block with respect to said length, said method comprising:

replacing said at least one original journal bearing block with a replacement offset journal bearing block, wherein said replacement offset journal bearing block includes at least two offset journal bearing bores offset with respect to either an inlet side or an outlet side of said pump, wherein said offset journal bearing bores each have a geometric center and a bearing bore centerline extending between said centers of said offset journal bearing bores; wherein said bearing bore centerline is offset with respect to said width of said offset journal bearing block and in parallel with said axial centerline; and operating said gear pump with said replacement offset journal bearing block to run-in said gears and said housing into desired operating positions and clearances.

9. The method according to claim 8, wherein said bearing bore centerline is offset toward said inlet side of said pump.

10. The method according to claim 8, wherein said offset is 0.0015 to 0.0025 inches with respect to said axial centerline.

11. The repair method according to claim 8, wherein the original journal bearing block does not include offset journal bearing bores.

12. The repair method according to claim 8, wherein the original journal bearing block also includes offset journal bearing bores.

* * * * *